US010413955B2

(12) United States Patent
Sikora et al.

(10) Patent No.: US 10,413,955 B2
(45) Date of Patent: Sep. 17, 2019

(54) TOOL FOR SHAPING AND/OR PARTIALLY PRESS HARDENING A WORKPIECE AND METHOD FOR SHAPING AND/OR PARTIALLY PRESS HARDENING A WORKPIECE

(71) Applicants: ThyssenKrupp Steel Europe AG, Duisburg (DE); thyssenkrupp AG, Essen (DE)

(72) Inventors: Sascha Sikora, Lünen (DE); Stéphane Graff, Unna (DE); Janko Banik, Altena (DE)

(73) Assignees: ThyssenKrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 248 days.

(21) Appl. No.: 15/533,832

(22) PCT Filed: Oct. 29, 2015

(86) PCT No.: PCT/EP2015/075149
§ 371 (c)(1),
(2) Date: Jun. 7, 2017

(87) PCT Pub. No.: WO2016/091454
PCT Pub. Date: Jun. 16, 2016

(65) Prior Publication Data

US 2017/0320121 A1 Nov. 9, 2017

(30) Foreign Application Priority Data

Dec. 11, 2014 (DE) ..... 10 2014 118 416

(51) Int. Cl.
*B21D 22/20* (2006.01)
*B21D 22/02* (2006.01)
(Continued)

(52) U.S. Cl.
CPC ..... *B21D 22/022* (2013.01); *B21D 22/06* (2013.01); *B21D 22/208* (2013.01);
(Continued)

(58) Field of Classification Search
CPC ..... B21D 22/022; B21D 37/16; B21D 22/06; B21D 22/208; B21D 35/001; C21D 1/673; C21D 1/06
(Continued)

(56) References Cited

U.S. PATENT DOCUMENTS 4,792,318 A 12/1988 Igaki et al.
7,159,437 B2 1/2007 Schroth et al.
(Continued)

FOREIGN PATENT DOCUMENTS

CN 202336541 U 7/2012
CN 203304430 U 11/2013
(Continued)

OTHER PUBLICATIONS

Abstract for JP2007190563 Published Feb. 8, 2007 Horie et al (Year: 2007).*
(Continued)

*Primary Examiner* — David B Jones
(74) *Attorney, Agent, or Firm* — RMCK Law Group PLC

(57) ABSTRACT

A tool may be used to shape and/or partially press harden a workpiece. In some examples, the tool may comprise a main body having a surface, as well as a heat conducting system containing a thermal medium. The heat conducting system is integrated in the tool in such a way that, for the heating of the surface, a heat radiating from a heat source is conducted by means of the heat conducting system to the surface of the main body. Further, the heat conducting system may comprise a thermal oil or a melt as the thermal medium. The surface of the main body may be configured to face the
(Continued)

workpiece during the shaping or partial press hardening of the workpiece.

17 Claims, 1 Drawing Sheet

(51) Int. Cl.
*B21D 22/06* (2006.01)
*B21D 35/00* (2006.01)
*C21D 1/06* (2006.01)
*B21D 37/16* (2006.01)
*C21D 1/673* (2006.01)

(52) U.S. Cl.
CPC ..... *B21D 35/001* (2013.01); *B21D 37/16* (2013.01); *C21D 1/06* (2013.01); *C21D 1/673* (2013.01)

(58) Field of Classification Search
USPC ..... 72/342.1
See application file for complete search history.

(56) References Cited

U.S. PATENT DOCUMENTS

| | | | | |
|---|---|---|---|---|
| 7,278,287 | B2 | 10/2007 | Bohner et al. | |
| 2006/0138698 | A1 | 6/2006 | Chapuis | |
| 2013/0205863 | A1* | 8/2013 | Loesch | B21D 22/06 72/342.7 |
| 2014/0056754 | A1* | 2/2014 | Naitou | B21D 22/208 420/90 |
| 2016/0281185 | A1* | 9/2016 | Graf | B21D 53/88 |
| 2016/0354827 | A1* | 12/2016 | Grimm | B21D 22/022 |
| 2017/0225214 | A1* | 8/2017 | Becker | B21D 22/022 |
| 2017/0320121 | A1* | 11/2017 | Sikora | B21D 22/022 |

FOREIGN PATENT DOCUMENTS

| | | | |
|---|---|---|---|
| DE | 102008035023 | A | 2/2010 |
| DE | 102012210958 | A | 4/2014 |
| EP | 2309008 | A | 4/2011 |
| JP | 2007190563 | A | 8/2007 |

OTHER PUBLICATIONS

Canadian Office Action for CA Application No. 2967511 dated Oct. 25, 2018, 6 pages.
English translation of International Search Report issued in PCT/EP2015/075149, dated Dec. 22, 2015 (dated Jan. 12, 2016).
English abstract for DE102008035023A.
Canadian Office Action for CA Application No. 2967511 dated Mar. 1, 2019, 8 pages.

* cited by examiner

TOOL FOR SHAPING AND/OR PARTIALLY PRESS HARDENING A WORKPIECE AND METHOD FOR SHAPING AND/OR PARTIALLY PRESS HARDENING A WORKPIECE

CROSS REFERENCE TO RELATED APPLICATIONS

This application is a U.S. National Stage Entry of International Patent Application Serial Number PCT/EP2015/075149, filed Oct. 29, 2015, which claims priority to German Patent Application No. DE 10 2014 118 416.5 filed Dec. 11, 2014, the entire contents of both of which are incorporated herein by reference.

FIELD

The present disclosure generally relates to tools for shaping and/or partially press hardening workpieces and to methods for shaping and/or partially press hardening workpieces.

BACKGROUND

In the hot shaping or press hardening of manganese-boron steels and possible composites, such as, for example, Tri-Bond®, tempered tools are used to locally reduce the cooling rate. As a result of the reduced cooling rate, an improved ductility is locally established on the thus treated workpiece. Locally, tool surface temperatures of more than 400° C., preferably between 500° C. and 550° C., are sought. Also light metals, such as aluminum and magnesium, for instance, are shaped in tempered tools at temperatures of more than 150° C. As a rule, electrically operated heating cartridges, which directly deliver their thermal energy into the tool steel, are used for the local tempering of the tools. Consequently, high temperature differences of more than 200° C., can be generated along the surface which run counter to the general interest in a homogeneous warming of the surface. Finally, the different temperatures lead to different cooling rates in the material of the workpiece and thus to different strengths in the finished workpiece. Moreover, it is often, for design reasons, not possible to arrange the heating cartridge such that a desired heat output arrives at a specific place. Furthermore, maintenance works on the tool at regular intervals require that the heating cartridges are exchanged. Since the heating cartridges, however, are inserted with fit into the tool, the high temperatures often give rise to integrally bonded connections between the heating cartridge and the tool, whereby a release of the heating cartridge from the tool is made more difficult.

DETAILED DESCRIPTION

Figure 1:
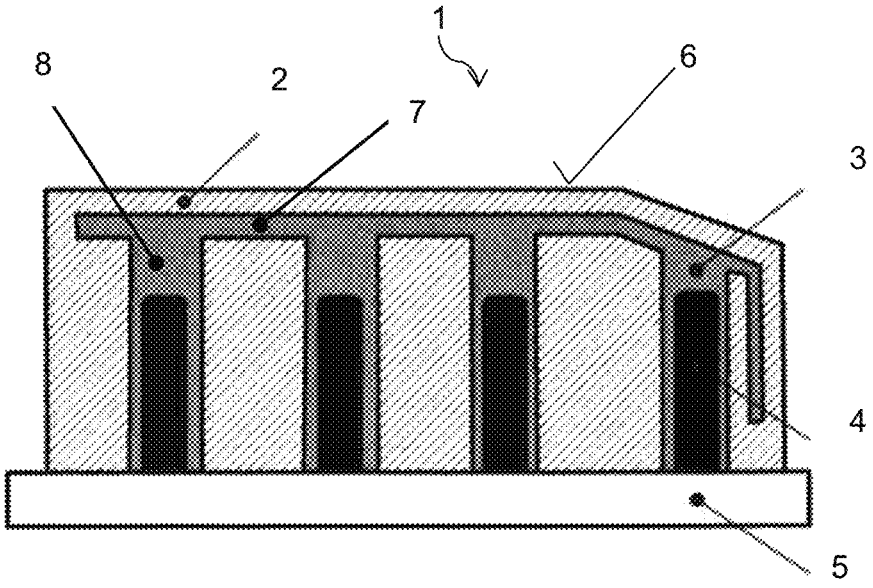
FIG. 1 is a sectional view of an example tool.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

An object of the present invention is to provide a tool for shaping and/or partially press hardening, with which, with regard to the temperature distribution, an as far as possible homogeneous region is provided on the tool surface. In addition, it would be desirable to simplify possible maintenance works in comparison to the prior art or to facilitate the handling of the maintenance works. The present object is achieved by a tool for shaping and/or partially press hardening a workpiece, wherein the tool, at least in the tempered region, comprises a main body having a surface and a heat conducting system containing a liquid thermal medium, wherein the heat conducting system is integrated in the tool in such a way that, for the heating of the surface, a heat radiating from a heat source is conducted by means of the heat conducting system to the surface of the main body, characterized in that the heat conducting system comprises a thermal oil or a melt as the thermal medium.

In relation to the prior art, the tool according to the invention has the advantage of the thermal oil or the melt, for instance salt melt or a zinc-containing melt, for example molten high-purity zinc (Zamak), which is disposed in the heat conducting system or is located in a closed system. Through the use of the thermal oil or the melt, an even heat distribution within the liquid thermal medium is achievable, whereby this uniform heat distribution in the liquid thermal medium advantageously ensures that the heat conducting system warms the surface uniformly (closed system). In addition, the heat conducting system ensures that the positioning of the heat source can advantageously be made more flexible, since it is no longer absolutely necessary to position the heat source in the direct vicinity of the surface.

Preferably, the shaping is constituted by a hot shaping and/or partial press hardening and the heated surface is intended to shape and to partially establish a higher ductility in the workpiece. The surface here has an operating temperature of at least 400° C., preferably an operating temperature between 500° C. and 550° C. In particular, it is imaginable that the tool is preferably used in "tailored tempering" to provide different tool segments respectively having a homogeneous heat distribution, wherein the different tool segments respectively differ in their temperature. The quality of the finished workpieces which are generated in "tailored tempering" is thereby advantageously able to be further improved. It is further provided that the heat source is a heating cartridge which preferably is indirectly or directly in contact with the heat conducting system. It is further provided that the heat source is disposed in the tool without contact with the main body. In the hot shaping of light metals such as aluminum and magnesium, for instance, the heated surface of the tools has an operating temperature of more than 150° C., in particular more than 200° C.

Advantageous embodiments and refinements of the invention can be derived from the subclaims and the description with reference to the drawings.

According to a further embodiment of the present invention, it is provided that the heat source is disposed within the heat conducting system. In particular, the heat source is surrounded or circumflowed by the thermal oil or the melt.

As a result, an integrally bonded connection, for instance in the form of a welding, between the main body and the heat source is able to be avoided. Consequently, the heat source can be released from the tool without great effort, for instance in maintenance works. According to a further embodiment of the present invention, it is provided that the heated surface, during the shaping of the workpiece, is facing the workpiece. In particular, the surface enters into contact with the workpiece in the course of the shaping. It is further provided that the surface forms a part of a male or female die and/or comprises a surface profile.

According to a further embodiment of the present invention, it is provided that the heat conducting system comprises a main channel, wherein the main channel extends substantially parallel to the surface. In particular, the main channel extends substantially planarly directly beneath the surface. The main channel here preferably follows the course of the surface profile. In particular, the distance of the heat conducting system to the main channel is substantially constant. An uniform distribution of the temperature along the surface is hence advantageously able to be further improved. According to a further embodiment, it is provided that the heat conducting system comprises a multiplicity of supply channels, which are fluidically connected to the main channel. It is here preferably provided that a plurality of heat sources are arranged in the supply channels. In particular, it is provided that for each supply channel at least one heat source is provided. In addition, the supply channels are preferably arranged at regular distances apart. In particular, the main channels and/or supply channels are configured as recesses in the main body. For instance, one of these recesses is formed by a borehole and/or a milled groove.

According to a further embodiment of the present invention, it is provided that the thermal medium is arranged statically in the heat conducting system, or the heat conducting system is flowed through by the thermal medium.

According to a further embodiment of the present invention, it is provided that the tool comprises a base plate, wherein an interspace between the base plate and the main body forms the heat conducting system. In particular, it is provided that a heat source is arranged on the base plate. In addition, it is imaginable that the multiplicity of heat sources is arranged on the base plate in such a way that the individual heat sources project into the supply channels. For instance, the multiplicity of heat sources is then able to be removed from the tool without great effort through the release of the base plate, with the multiplicity of heat sources, from the main body. The performance of the maintenance works is thereby further facilitated.

A further subject of the present invention is a method for shaping and/or partially press hardening a workpiece with a tool according to the invention.

A further subject of the present invention is a method for exchanging a heat source from a tool according to the invention. Further details, features and advantages of the invention emerge from the drawings and from the following description of preferred embodiments on the basis of the drawings. The drawings here illustrate merely exemplary embodiments of the invention which do not restrict the inventive concept.

In the various FIGURES, same parts are always provided with the same reference symbols and are therefore generally also named or mentioned only once in each case.

In FIG. 1, a tool 1 according to an exemplary embodiment of the present invention is represented. It is here preferably provided that this is constituted by a tool 1 for shaping, in particular hot shaping and/or partial press hardening. For instance, with the tool 1, workpieces (not represented here) made of a manganese-boron steel or of a composite, in particular TriBond, are shaped. For this the tool 1 comprises a main body 2, on the workpiece-facing side of which can be found a surface 6, which enters into contact with the workpiece in the course of the shaping. It is here further provided that this surface 6 of the tool 1 has an operating temperature of more than 400° C., in particular an operating temperature between 500° C. and 550° C., when the workpiece is deformed or shaped by the tool 1. In addition, it is preferably provided that the tool comprises besides the main body 2 a base plate 5 and, by the arrangement of the base plate 5 and the main body 2, an interspace is formed. As a result of the preferred filling of this interspace with a thermal oil or a melt (salt melt), the interspace acquires the functionality of a heat conducting system 3, which conducts to the surface 6 a heat radiating from a heat source 4. For an as far as possible uniform distribution, the heat conducting system 3 comprises a main channel 7, which extends substantially parallel to the surface 6 of the main body 2, in particular planarly, and particularly preferably runs directly beneath the surface 6. In particular, the distance of the main channel from the surface 6 is preferably less than 6 cm, preferably less than 4 cm, and particularly preferably less than 2 cm. It is further provided that the heat conducting system 3 is of rib-like configuration. The heat conducting system 3 here comprises a plurality of supply channels 8, which are respectively fluidically connected to the main channel 7. In particular, the heat sources 4 are disposed within the supply channels 8. It is here conceivable that the heat sources 4 are fitted directly on the base plate 5, and/or the heat sources 4 are directly surrounded, in particular circumflowed, by the thermal oil or the melt (salt melt) (closed system). The heat source 4 is here arranged on the tool 1 preferably without contact with the main body 2. In particular, it is imaginable that for maintenance works on the heat sources 4, in particular heating cartridges, the base plate 5 is released from the main body 2. For this purpose, it is provided that the base plate 5 is attached detachably to the main body 2.

REFERENCE SYMBOL LIST

1 tool
2 main body
3 heat conducting system
4 heat source
5 base plate
6 surface
7 main channel
8 supply channel

What is claimed is:

1. A tool for at least one of shaping or partially press hardening a workpiece, the tool comprising:

a main body having a surface, and a supply channel formed in the main body; and a heat conducting system containing a heat source disposed in the supply channel with a liquid thermal medium, the heat conducting system being integrated in the main body such that heat radiating from the heat source is conducted by the heat conducting system to the surface.

2. The tool of claim 1 wherein the surface is configured to face the workpiece during the at least one of shaping or partially press hardening the workpiece.

3. The tool of claim 1 wherein the heat conducting system comprises a main channel that extends substantially parallel to the surface.

4. The tool of claim 3 wherein the heat conducting system comprises supply channels that are in fluid connection to the main channel.

5. The tool of claim 1 wherein the thermal medium is a fluid configured to flow through the heat conducting system.

6. The tool of claim 1 further comprising a base plate, wherein the heat conducting system further includes an interspace between the base plate and the main body.

7. The tool of claim 1 wherein the thermal medium is a thermal oil.

8. The tool of claim 1 wherein the thermal medium is a melt.

9. The tool of claim 8 wherein the melt is a salt melt.

10. A method for shaping and/or partially press hardening a workpiece with a tool including a main body having a surface, and a heat conducting system containing a heat source disposed within a supply channel formed in the main body and heating a thermal medium, the method comprising:

heating the surface with the heat conducting system by conducting heat from the heat source to the surface via the thermal medium; and contacting the workpiece with the heated surface.

11. A tool for at least one of shaping and partially press hardening a workpiece, the tool comprising:

a base plate;

a main body releasably coupled to the base plate, the main body comprising:

a workpiece surface;

a plurality of supply channels;

a main channel disposed beneath the workpiece surface and fluidly connecting the plurality of supply channels; and a plurality of individual heat sources, wherein at least one individual heat source of the plurality of heat sources is disposed in each supply channel of the plurality of supply channels within a liquid thermal medium, wherein the plurality of individual heat sources are configured to heat the liquid thermal medium within the supply channels and the main channel to thereby heat the workpiece surface for facilitating the at least one of shaping and press hardening the workpiece.

12. The tool of claim 11, wherein each individual heat source is a heating cartridge coupled to the base and extending into one supply channel of the plurality of supply channels, wherein the heat cartridges are removable from the main body by releasing the base plate from the main body.

13. The tool of claim 11, wherein the supply channels are formed in the main body by at least one of a borehole and a milled groove, the supply channels being spaced at regular distances.

14. The tool of claim 11, wherein the main channel extends substantially perpendicularly to the workpiece surface.

15. The tool of claim 14, wherein a distance from the main channel to the workpiece surface is less than 2.0 cm.

16. The tool of claim 11, wherein the plurality of individual heat sources heat the workpiece surface to a temperature of between 500° C. and 550° C. via the liquid thermal medium.

17. The tool of claim 11, wherein the liquid thermal medium is a zinc-containing melt.

* * * * *